US006917147B2

(12) United States Patent
Dijon et al.

(10) Patent No.: US 6,917,147 B2
(45) Date of Patent: Jul. 12, 2005

(54) CATHODE STRUCTURE WITH EMISSIVE LAYER FORMED ON A RESISTIVE LAYER

(75) Inventors: Jean Dijon, Champagnier (FR); Adeline Fournier, Mont Saint Martin (FR); Brigitte Montmayeul, Bernin (FR); Aimé Perrin, Saint Ismier (FR)

(73) Assignee: Commissariat a l'Energie Atomique, Paris (FR)

( * ) Notice: Subject to any disclaimer, the term of this patent is extended or adjusted under 35 U.S.C. 154(b) by 24 days.

(21) Appl. No.: 10/367,885

(22) Filed: Feb. 19, 2003

(65) Prior Publication Data

US 2003/0184357 A1 Oct. 2, 2003

(30) Foreign Application Priority Data

Feb. 19, 2002 (FR) ..... 02 02078

(51) Int. Cl.[7] ..... H01J 1/30

(52) U.S. Cl. ..... 313/310; 313/309; 313/336; 313/338; 313/351; 313/495; 445/24; 445/25; 445/50

(58) Field of Search ..... 313/495, 496, 313/497, 336, 351, 309, 310; 445/24, 25, 50

(56) References Cited

U.S. PATENT DOCUMENTS 5,319,279 A 6/1994 Watanabe et al. ..... 313/309
5,522,751 A * 6/1996 Taylor et al. ..... 445/50
5,717,285 A 2/1998 Meyer et al. ..... 313/495
5,759,078 A * 6/1998 Levine et al. ..... 445/24
5,821,679 A * 10/1998 Makishima ..... 313/310
6,465,950 B1 * 10/2002 Baldi et al. ..... 313/497
6,476,408 B1 11/2002 Legagneux et al. ..... 257/10
6,563,260 B1 * 5/2003 Yamamoto et al. ..... 313/495

FOREIGN PATENT DOCUMENTS

| | | | |
|---|---|---|---|
| EP | 0 503 638 | 9/1992 | |
| EP | 0 616 356 | 9/1994 | |
| FR | 2 780 808 | 1/2000 | |
| WO | WO 118838 A1 * | 3/2001 | ..... H01J/1/30 |

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A triode type cathode structure including a cathode assembly composed of a cathode electrode at least one electron emitter and a resistive layer inserted between the cathode electrode and the at least one electron emitter to connect them together electrically. The triode cathode structure also includes a grid electrode separated from the cathode assembly by a layer of electrical insulation. The cathode electrode is arranged in a first plane and the at least one electron emitter is arranged in a second plane parallel to the first plane and the cathode electrode and each electron emitter are separated by a same distance measured in a third plane parallel to the first and second planes.

15 Claims, 7 Drawing Sheets

CATHODE STRUCTURE WITH EMISSIVE LAYER FORMED ON A RESISTIVE LAYER

TECHNICAL FIELD

The invention relates to a cathode structure with an emissive layer formed on a resistive layer, this cathode structure being useable in a field emission flat screen.

STATE OF PRIOR ART

A display device by cathode luminescence excited by field emission comprises a cathode or electron emitting structure and an anode facing it coated with a luminescent layer. The anode and the cathode are separated by a space in which a vacuum has been created.

The cathode is either a source based on microtips, or a source based on an emissive layer with a weak threshold field. The emissive layer may be a layer of carbon nanotubes or nanotubes of other structures based on carbon, or based on other materials or multi-layers (AlN, BN).

The cathode structure may be of the diode type or the triode type. Triode structures have an additional electrode called the grid that facilitates extraction of electrons from the emissive source. Several triode structures have already been considered. They may be classified into two main families as a function of the position of the grid with respect to the cathode.

A first family of triode structures includes structures in which the cathode conductor is deposited at the bottom of holes formed in an insulating layer and in which the grid is located on the insulating layer. These triode structures are called type I structures in the following. This type of triode structure is defined in document FR-A-2 593 953 (corresponding to U.S. Pat. No. 4,857,161), that divulges a process for making a display device by cathode luminescence excited by field emission. The electron emitting material is deposited on a conducting layer visible at the bottom of holes made in an insulating layer that supports an electron extraction grid.

FIG. 1 shows a sectional and diagrammatic view of a type I cathode structure according to prior art, for a cathode luminescence display device excited by. field emission. A single emission device is shown in this figure. A circular hole 2 is formed through a layer 1 made of an electrically insulating material. A conducting layer 3 is arranged at the bottom of the hole 2 forming the cathode and supporting a layer 4 of electron emitting material. The top face of the insulating layer 1 supports a metallic layer 5 forming an extraction grid and surrounding the hole 2.

A second family of triode structures includes structures in which the cathode conductor is deposited on an insulating layer and in which the grid is located under the insulating layer. These triode structures will be called type II structures in the following. This type of triode structure is described in documents FR-A-2 798 507 and FR-A-2 798 508.

FIG. 2 shows a sectional and diagrammatic view of a type II cathode structure according to known art, for a cathode luminescence display device excited by field emission. A single emission device is shown in this figure. A layer 11 of an electrically insulating material supports a grid electrode 15 on its lower face composed of two parts surrounding a cathode 13 placed on the upper face of the layer 11 and supporting a layer 14 of electron emitting material.

If type I and II cathode structures are to operate correctly for electronic emission, the stack at the cathode has to be made more complex by adding a resistive layer between the cathode conductor and the emissive layer, with the objective of limiting the current emitted by individual emitters so as to make emission uniform, as described in document EP-A-0 316 214 (corresponding to U.S. Pat. No. 4, 940, 916).

The location of an emitting layer in precise areas of a screen requires that a catalyst layer (typically Fe, Co, Ni or alloys of these materials) is deposited on these areas, which then enables selective growth of the emitting layer. These areas are called growth areas.

FIG. 3 shows the complete stack above the cathode conductor for type I and II cathode structures, after growth of the emitting layer. This figure shows a sectional view of a cathode conductor 23 supporting a resistive layer 26, a catalyst layer 27 and an emissive layer 24 in sequence.

Problems encountered during production of these devices are related to growth of the emissive layer that occurs at high temperature (from 500° to 700° C.). This step leads to diffusion of part of the metallic catalyst in the resistive layer which is generally made of silicon. This diffusion makes the resistive layer very conducting, which eliminates its fundamental role as emission regulator. FIG. 4 shows a diffusion volume 28 of the metallic catalyst in the resistive layer 26 after the growth step of the emissive layer 24, for the device in FIG. 3. This problem is common to type I and II cathode structures.

PRESENTATION OF THE INVETNION

To overcome this problem, this invention proposes a structure in which the integrity of the resistive layer is maintained after growth of the emissive layer, which provides uniform electronic emission.

The purpose of the invention is a triode type cathode structure comprising a cathode assembly composed of a cathode electrode, a layer of electron emitting material formed from a growth area and intended to emit electrons from an emission face, and a resistive layer inserted between the cathode electrode and the layer of electron emitting material to connect them together electrically, the structure also comprising a grid electrode separated from the said cathode assembly by a layer of electrical insulation, characterized in that the cathode electrode and the layer of electron emitting material are arranged one at the side of the other.

According to one particular embodiment, the growth area is composed of several growth pads separated from each other, and the layer of electron emitting material is distributed on these pads. The resistive layer may then be eliminated between the growth pads.

The cathode structure may be type I, in which case the grid electrode is located on the side of the emission face of the layer of electron emitting material, with respect to said cathode assembly. If an opening is formed in the grid electrode and in the electrical insulation layer to expose the layer of electron emitting material, the layer of electron emitting material may be located in the central part of the opening. It may also occupy the entire width of the opening, the cathode electrode being set back laterally from the opening. Advantageously, since the opening forms a rectangular trench, the electron emitting material is also rectangular. If, as mentioned above, the growth area is composed of several growth pads separated from each other and the growth pads are round, the opening may comprise a corresponding number of cylindrical holes (tangent or not) centered on the pads.

Advantageously, the cathode electrode comprises two parts surrounding the layer of electron emitting material.

The cathode structure may be type II, in which case the grid electrode is located on the side opposite the emission face of the layer of electron emitting material, with respect to said cathode assembly.

Advantageously, the grid electrode comprises two parts surrounding the cathode assembly. Preferably, the cathode electrode is centered between the two parts of the grid electrode, the growth area being composed of at least one group of two growth pads located on each side of the cathode electrode.

Regardless of the type of cathode structure, the growth area may be a growth multi-layer. This growth multi-layer may be electrically connected to the resistive layer through a metallic conductor.

Another purpose of the invention is a flat screen with field emission comprising several cathode structures as defined above.

BRIEF DESCRIPTION OF THE DRAWINGS

The invention will be better understood and other advantages and special features will appear after reading the following description given as a non-restrictive example accompanied by the attached drawings, wherein.

DETAILED DESCRIPTION OF EMBODIMENTS OF THE INVENTION

Figure 1:
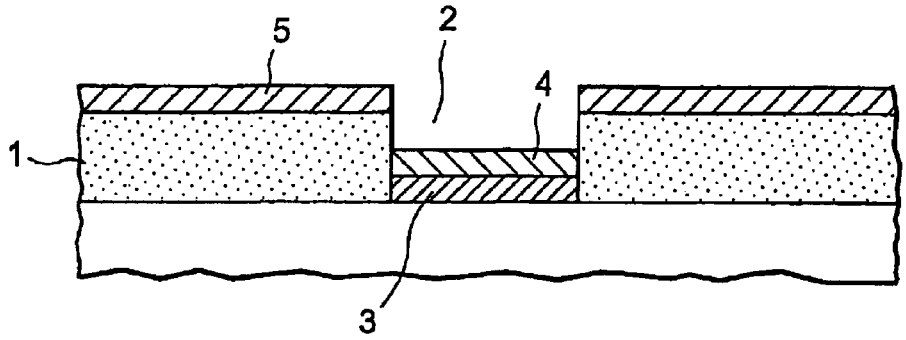
FIG. 1 PRIOR ART
FIG. 1, already described, is a sectional view of a triode type of cathode structure with an emissive layer according to known art, FIG. 2, already described, is a cross-sectional view of a triode type of cathode structure with an emissive layer according to known art, FIGS. 3 and 4, already described, show cross-sectional views of a cathode assembly comprising a superposed cathode conductor, a resistive layer, a catalyst layer and an emissive layer according to known art.
Figure 2:
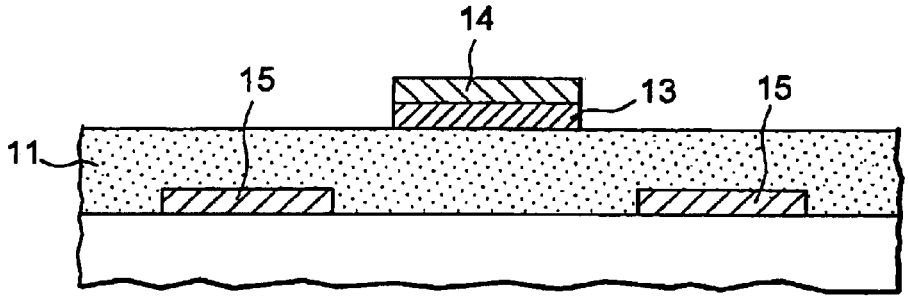
FIG. 2 PRIOR ART
Figure 3:
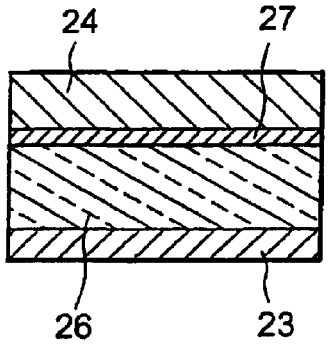
FIG. 3 PRIOR ART
Figure 4:
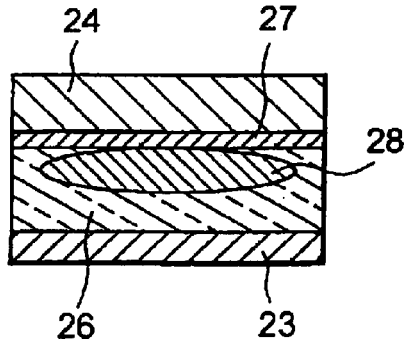
FIG. 4 PRIOR ART
Figure 5:
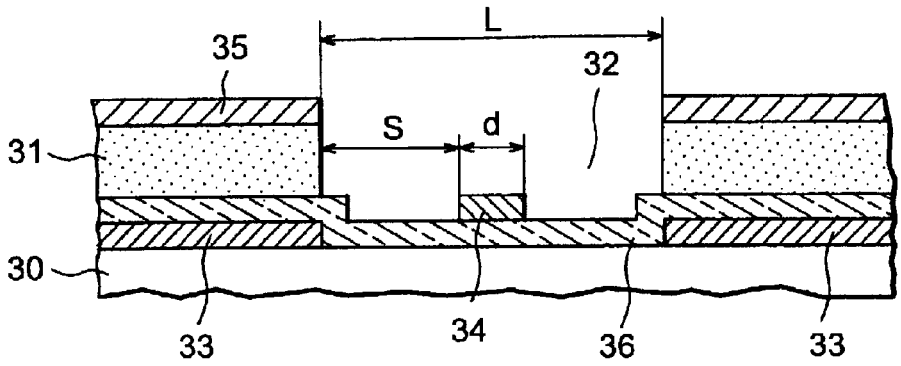
FIG. 5 is a cross-sectional view of a type I cathode structure with emissive layer according to this invention.

FIG. 5 shows a cross-sectional view of a type I cathode structure with emissive layer according to this invention. This cathode structure comprises a support 30 on which are superposed a cathode electrode 33 in two parts, a resistive layer 36 covering the two parts of the cathode electrode 33 and the support surface 30 located between these two parts, an insulating layer 31 and a metallic layer 35 forming an electron extraction grid. A hole 32 exposes the resistive layer 36. A layer of emissive material 34 at the center of the hole 32 formed from a growth area is supported on the resistive layer 36.

For example, the hole 32 is a trench with width L formed in the insulating layer 31 and the extraction grid 35. The width d of the growth area of the layer of emissive material 34 is small compared with the width L. This growth area is located at a distance S from parts of the cathode electrode 33. It is electrically connected to these parts through the resistive layer 36 with thickness e. The parts of the cathode electrode 33 are vertically in line with the extraction grid 35. They can also be set back from the line of the grid.

Figure 6:
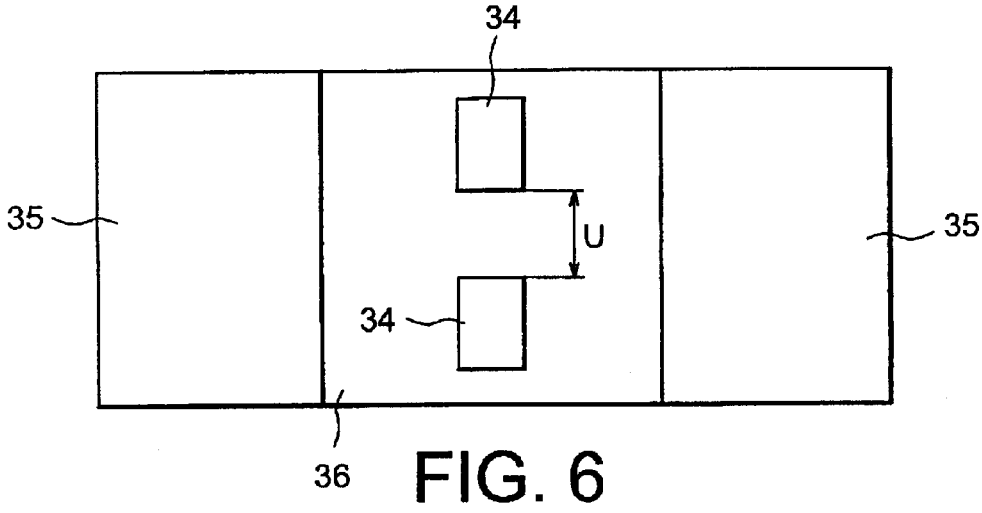
FIGS. 6 and 7 are top views of a type I cathode structure with emissive layer according to this invention.

The growth area may be discontinuous and structured in pads as shown in FIG. 6 which is a possible top view of the cathode structure in FIG. 5. It shows that the layer of emissive material 34 is distributed on two growth pads separated by a distance U which is of the same order of magnitude as the distance S.

Figure 7:
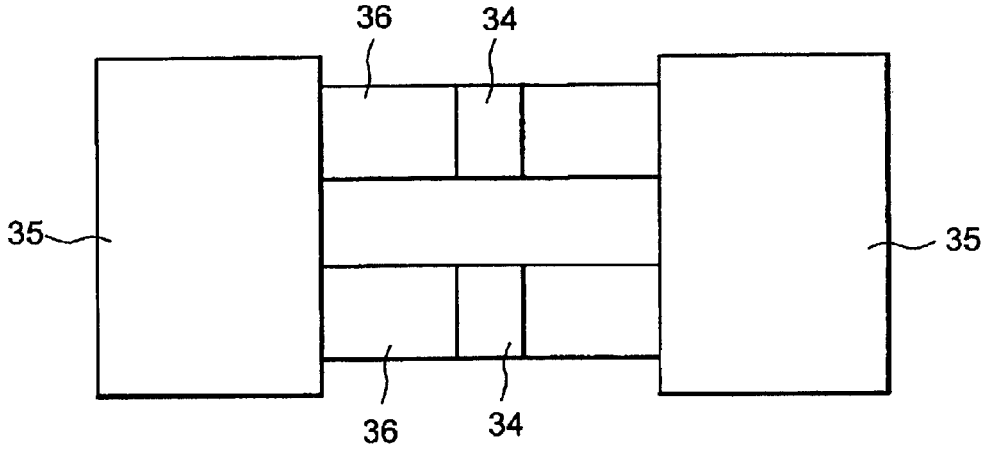

Another possible top view of the cathode structure in FIG. 5 is shown in FIG. 7. In this variant embodiment, the resistive layer 36 is etched between the growth pads of the layer of emissive material 34.

Figure 8:
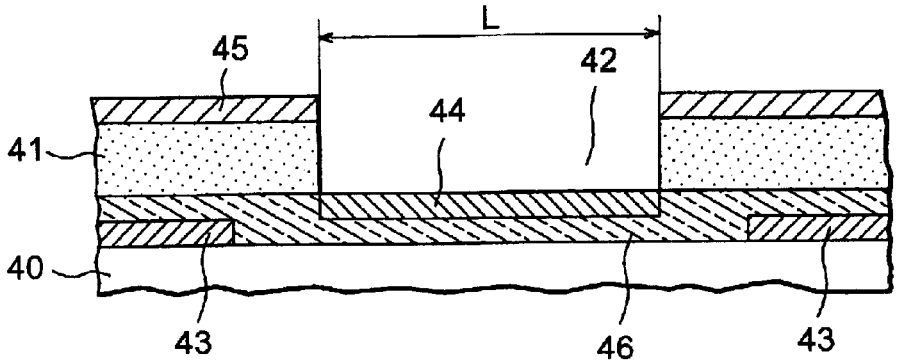
FIG. 8 is a cross-sectional view of another type I cathode structure with emissive layer according to this invention.

FIG. 8 shows a cross-sectional view of a type I cathode structure with emissive layer according to this invention. This cathode structure comprises a support 40 on which a cathode electrode 43 is superposed in two parts, followed by a resistive layer 46 covering the two parts of the cathode electrode 43 and the support surface 40 located between these two parts, an insulating layer 41 and a metallic layer 45 forming an electron extraction grid. A hole 42, for example a trench with width L, is formed in the insulating layer 41 and the extraction grid 45.

The layer of emissive material 44 is formed starting from a growth area deposited on the resistive layer 46 and which occupies the entire depth of the trench 42. Therefore, it has the same width as the trench. The cathode electrode is set back from the trench by a distance S.

Figure 9:
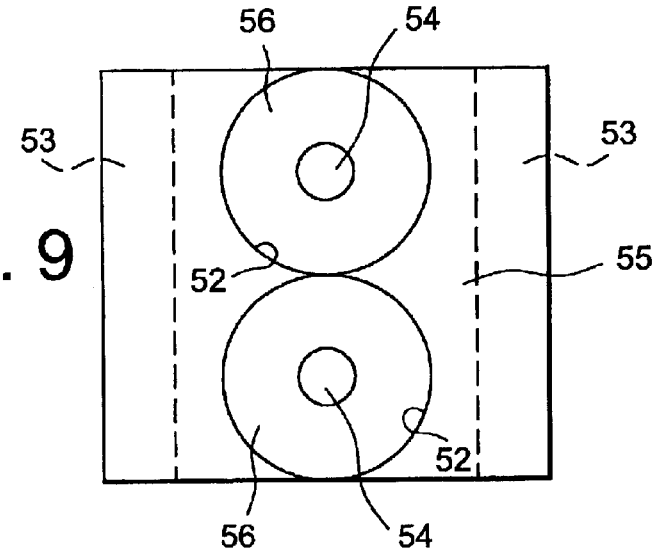
FIG. 9 is a top view of another type I cathode structure with emissive layer according to this invention.

FIG. 9 shows a top view of yet another type I cathode structure with emissive layer according to this invention. In this variant, the emissive layer 54 is formed on round growth pads and is located at the bottom of cylindrical holes 52 centered on these pads that may or may not be tangent. This figure also shows the resistive layer 56 on which the growth pads are formed, together with the extraction grid 55 and the cathode electrode 53 in two parts.

Figure 10:
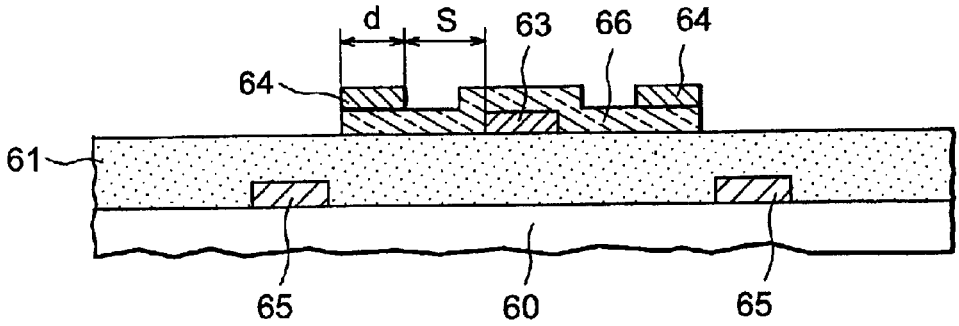
FIGS. 10 and 11 show cross-sectional and top views respectively of a type II cathode structure with emissive layer according to this invention.
Figure 11:
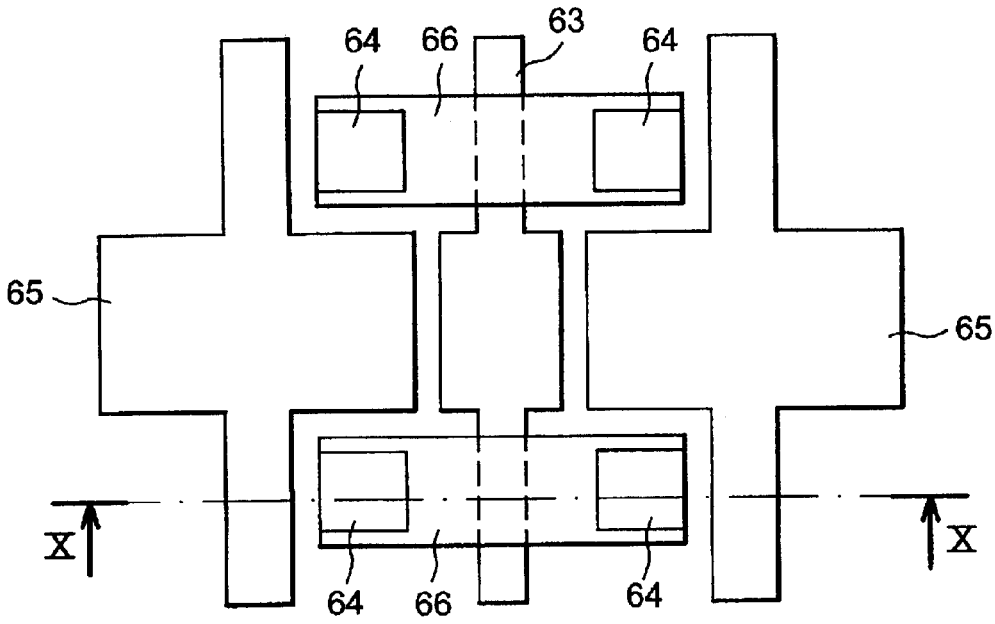

FIGS. 10 and 11 show cross-sectional and top views respectively of a type II cathode structure with emissive layer according to this invention. FIG. 10 is a view along section X—X in FIG. 11.

With reference to FIGS. 10 and 11, a support 60 supports a grid electrode 65 in two parts, followed by an insulating layer 61 and a cathode assembly centered on the grid electrode 65. The cathode assembly comprises a cathode electrode 63, a resistive layer 66 with width L deposited on the cathode electrode 63 and projecting on either sides of this electrode; and an emissive layer 64 formed on several pads deposited on projecting parts of the cathode electrode 63. As shown in FIG. 11, the resistive layer 66 is distributed in two groups each supporting two growth pads.

The width of the growth pads is d and they are located at a distance S from the cathode electrode 63.

A variant of the invention in this case would consist of having a continuous resistive layer rather than etched in strips.

The invention solves difficulties encountered for type I and II structures according to prior art. The short-circuit of the resistive layer that occurs in structures according to prior art by diffusion of the catalyst in this resistive layer is eliminated because the cathode electrode is moved away. Diffusion takes place preferentially in the thickness of the resistive layer and therefore does not destroy the lateral resistance, the separation distance being such that a satisfactory resistance remains. The distribution of the emissive layer in separate pads also assures electrical independence between different emitting areas and therefore provides independent action of the resistive layer for each pad, which is why the emission is uniform.

It is possible to empirically assign a minimum distance to S, in other words to the distance separating the growth area from the cathode electrode. This distance must be greater than the lateral diffusion of the catalyst.

Figure 12:
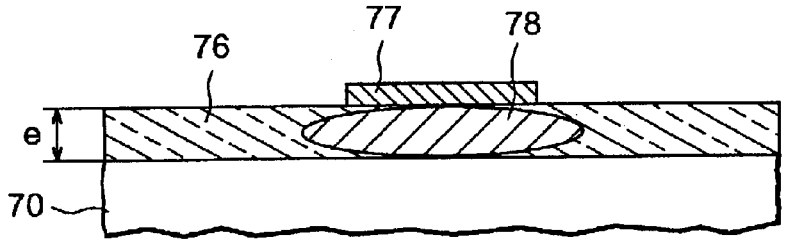
FIG. 12 is a cross-sectional and explanatory view of a part of a cathode assembly according to this invention.

FIG. 12 is a cross-sectional view of a part of a cathode assembly according to the invention. It shows a resistive layer 76 deposited on a support 70 and a catalyst layer 77 located on the resistive layer and that will act as a growth area. During growth of the emissive layer, the catalyst diffusion takes place within a diffusion volume 78 spreading over a distance similar to the thickness e of the resistive layer 76. It can be estimated that S must be of the order of several times the thickness e, typically 3 to 5 $\mu$m. This value is given for guidance only and is in no way limitative.

In the example embodiments described above, the growth area is simply composed of a catalyst layer. The growth area may be composed of a stack of materials chosen to facilitate growth of carbonated structures emitting electrons. It is also possible not to make the growth area directly on the resistive layer, but to connect it to the resistive layer through a metallic conductor forming part of the growth structure.

Figure 13:
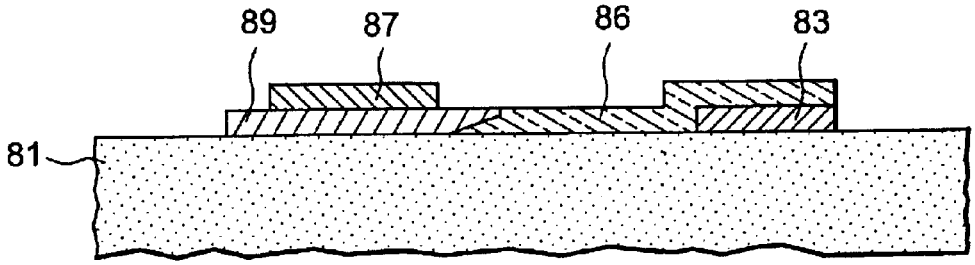
FIG. 13 is a cross-sectional view of a variant cathode assembly according to this invention.

This is shown in FIG. 13 which is a sectional view of a part of a cathode assembly for a type II cathode structure according to the invention. An insulating layer 81 supports a cathode electrode 83 and a resistive layer 86 overlapping the cathode electrode 83. The side of the resistive layer 86 is in electrical contact with a metallic conductor 89 on which a growth multi-layer 87 was formed. For example, the growth multi-layer may be a stack comprising TiN and another catalyst material such as Fe, Co, Ni and Pt. The metallic conductor 89 may be a metal such as Cr, Mo and Nb.

FIGS. 14A to 14F illustrate a process for embodiment of a type I cathode structure according to the invention, this process implementing vacuum deposition and photolithography techniques.

Figure 14A:
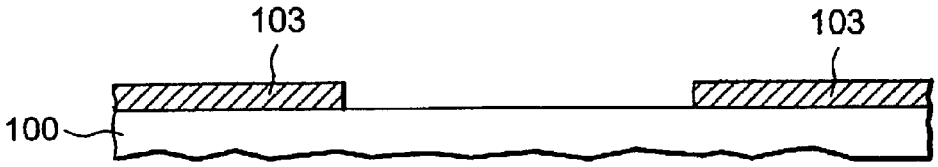
FIGS. 14A to 14I illustrate processes for making a type I cathode structure with an emissive layer according to this invention.

The cathode conductor is obtained by depositing a conducting material, for example molybdenum, niobium, copper or ITO, on a support 100 (see FIG. 14A). The deposit of conducting material is etched in strips, typically 10 $\mu$m wide and with a pitch equal to 25 $\mu$m. FIG. 14A shows two strips that will be combined to form a cathode electrode 103.

Figure 14B:
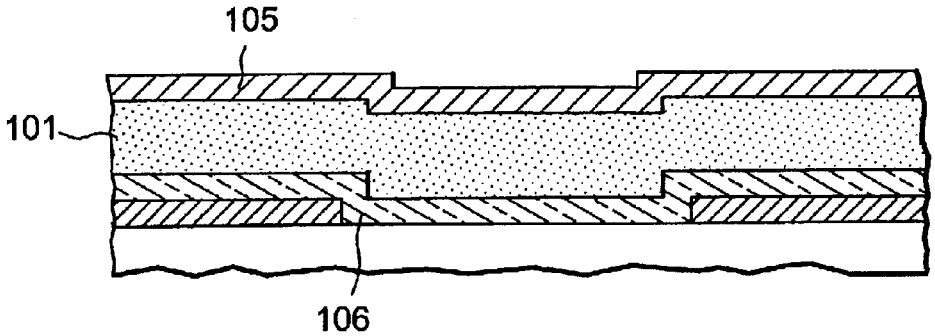

Several depositions are then made as shown in FIG. 14B; a 1.5 $\mu$m thick resistive layer 106 made of amorphous silicon, followed by a 1 $\mu$m thick insulating layer 101 made of silica or silicon nitride, and finally a metallic layer 105 made of niobium or molybdenum that will form the electron extraction grid.

Figure 14C:
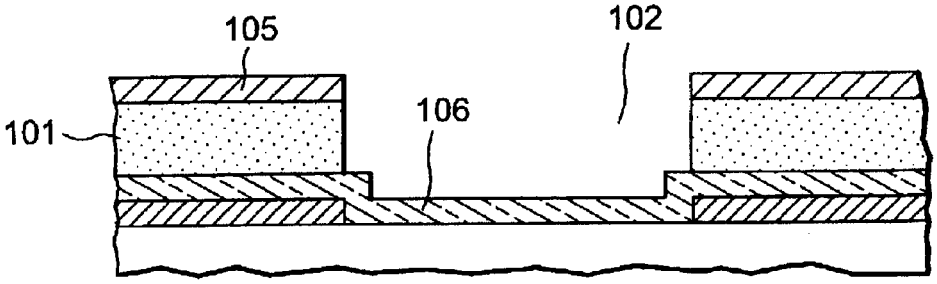

The metallic layer 105 and the insulating layer 101 are then etched simultaneously with a 15 $\mu$m wide hole or trench 102 to expose the resistive layer 106. This is shown in FIG. 14C.

Figure 14D:
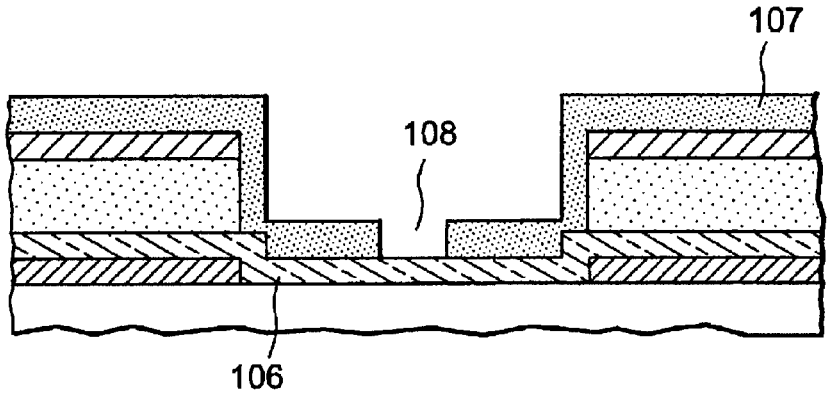

FIG. 14D shows the structure obtained after deposition of a sacrificial layer 107 made of resin and formation of a 6 $\mu$m wide and 10 to 15 $\mu$m long opening 108 in the layer 107, exposing the resistive layer 106. The width of the opening 108 corresponds to the width of the emissive layer to be made.

Figure 14E:
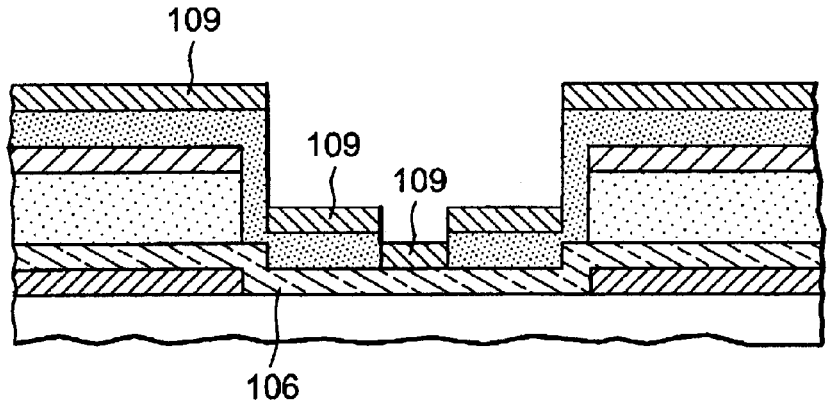

A catalytic deposition of iron, cobalt or nickel is then made on the structure. As shown in FIG. 14E, this catalytic deposition causes the formation of a discontinuous growth layer 109 on the sacrificial layer 107 and on the exposed part of the resistive layer 106.

Figure 14F:
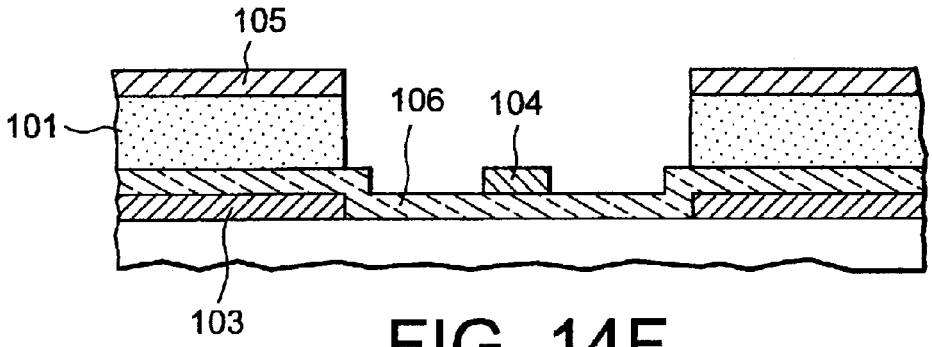

The sacrificial layer is then eliminated by a "lift-off" technique that provokes the elimination of parts of the growth layer located on this sacrificial layer. There is still part of the growth layer in the central part of the resistive layer 106. This enables growth of the emissive layer 104 as shown in FIG. 14F.

A variant of this cathode structure comprises a multi-layer instead of the catalyst, for example a dual layer composed of a barrier layer like TiN and then a catalyst. The multi-layer may also be more complex to encourage growth of the emitting layer.

The process for embodiment of a cathode structure in which the growth area is connected to the resistive layer through a metallic conductor begins with the same steps 14A to 14D as the process described above. These steps are then followed by the steps illustrated in FIGS. 14G to 14I.

Figure 14G:
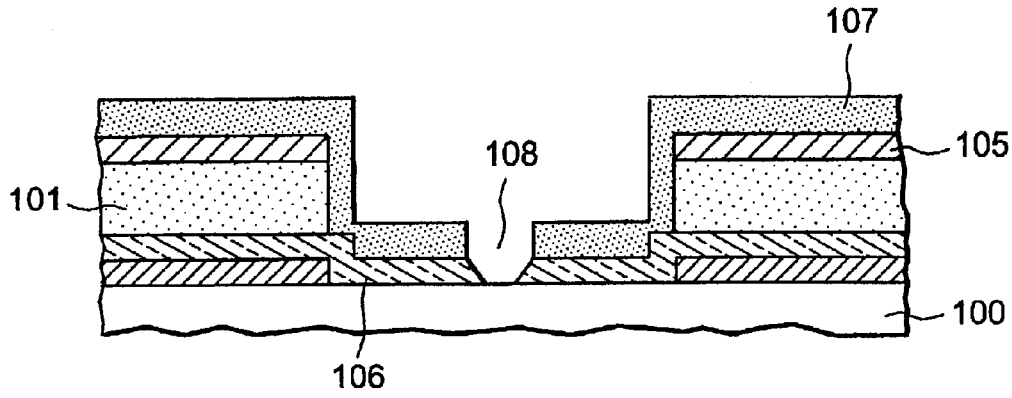

FIG. 14G shows that the resistive layer 106 was etched along the line of the hole 108 to reveal the support 100.

Figure 14H:
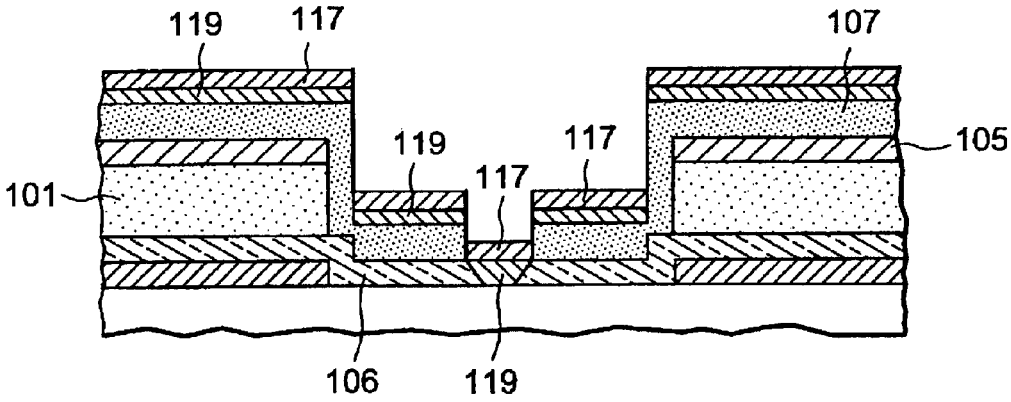

Finally, as shown in FIG. 14H, a metallic layer 119 is deposited to achieve electrical contact between the growth area and the resistive layer 106. A layer 117 of catalyst or a multi-layer structure is then deposited on the metallic layer 119.

Figure 14I:
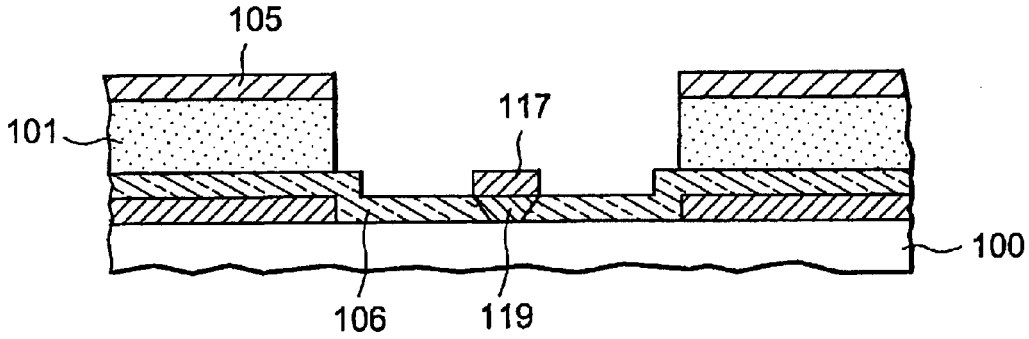

The sacrificial layer 107 is then eliminated using a lift-off technique, which eliminates parts of the metallic layer 119 and the catalyst layer 117 located on this sacrificial layer. A part of the metallic layer 119 remains on the support 100 to connect the resistive layer 106 to the catalyst pad 117 deposited on this part of the metallic layer 119 as shown in FIG. 14I. Growth of the emissive layer can then begin.

What is claimed is:

1. Triode cathode structure comprising:

a cathode assembly including a cathode electrode at least one electron emitter formed from a growth area and configured to emit electrons from an emission face, and a resistive layer disposed so as to support each electron emitter and to extend to the cathode electrode to connect them together electrically, and a grid electrode separated from the said cathode assembly by a layer of electrical insulation, wherein the cathode electrode is seperated from the at least one electron emitter by a distance greater than a lateral diffusion of a catalyst used to grow the at least one emitter on the growth area.

2. Cathode structure according to claim 1, wherein the growth area includes at least two growth pads separated from each other, and at least one electron emitter on each pad.

3. Cathode structure according to claim 2, wherein the resistive layer is eliminated between growth pads.

4. Cathode structure according to claim 1, wherein the grid electrode is located adjacent to the emission face of said cathode assembly.

5. Cathode structure according to claim 4, wherein at least one opening is formed in the grid electrode and in the electrical insulating layer to expose the at least one electron emitter located in the central part of the at least one opening.

6. Cathode structure according to claim 4, wherein at least one opening is formed in the grid electrode and in the layer of electrical insulating layer to expose the at least one electron emitter configured to occupy the entire width of the at least one opening.

7. Cathode structure according to claim 5, wherein the at least one opening forms a rectangular trench, and the shape of the at least one electron emitter is also rectangular.

8. Cathode structure according to claim 5, wherein the growth area includes at least two round growth pads and said at least one opening comprises a corresponding number of cylindrical holes.

9. Cathode structure according to claim 1, wherein the cathode electrode comprises two parts surrounding the at least one electron emitter.

10. Cathode structure according to claim 1, wherein the grid electrode is located on a side opposite the at least one electron emitter, with respect to said cathode electrode.

11. Cathode structure according to claim 10, wherein the grid electrode comprises two parts surrounding the cathode assembly.

12. Cathode structure according to claim 11, wherein the cathode electrode is centered between the two parts of the grid electrode, the growth area including at least one group of two growth pads on each side of the cathode electrode.

13. Cathode structure according to claim 1, wherein the growth area is a growth multi-layer.

14. Cathode structure according to claim 13, wherein the growth multi-layer is electrically connected to the resistive layer through a metalllic conductor.

15. Field emission flat screen comprising several cathode structures according to any one of claims 1 to 14.

* * * * *